US007086767B2

(12) United States Patent
Sidwell et al.

(10) Patent No.: US 7,086,767 B2
(45) Date of Patent: Aug. 8, 2006

(54) THERMALLY EFFICIENT LED BULB

(75) Inventors: Steven C. Sidwell, Hopkinton, NH (US); Charles M. Coushaine, Rindge, NH (US); Paul Lyman, Guilford, VT (US)

(73) Assignee: OSRAM Sylvania Inc., Danvers, MA (US)

( * ) Notice: Subject to any disclaimer, the term of this patent is extended or adjusted under 35 U.S.C. 154(b) by 100 days.

(21) Appl. No.: 10/843,811

(22) Filed: May 12, 2004

(65) Prior Publication Data

US 2005/0254264 A1 Nov. 17, 2005

(51) Int. Cl.
*F21S 8/10* (2006.01)
*F21V 21/00* (2006.01)
*F21V 7/04* (2006.01)

(52) U.S. Cl. ..... 362/545; 362/249; 362/294; 362/555

(58) Field of Classification Search ..... 362/227, 362/240, 294, 545, 555, 249, 362; 315/185 R
See application file for complete search history.

(56) References Cited

U.S. PATENT DOCUMENTS 5,806,965 A * 9/1998 Deese ..... 362/249
5,890,794 A * 4/1999 Abtahi et al. ..... 362/294
6,426,274 B1 * 7/2002 Tayanaka ..... 438/458
6,580,228 B1 * 6/2003 Chen et al. ..... 315/185 R
6,634,770 B1 * 10/2003 Cao ..... 362/294
6,659,632 B1 * 12/2003 Chen ..... 362/545
6,682,211 B1 * 1/2004 English et al. ..... 362/545
6,848,819 B1 * 2/2005 Arndt et al. ..... 362/545
6,851,837 B1 * 2/2005 Tessnow et al. ..... 362/362
6,880,962 B1 * 4/2005 Coushaine et al. ..... 362/555
6,921,869 B1 * 7/2005 Terunuma et al. ..... 174/256
6,948,829 B1 * 9/2005 Verdes et al. ..... 362/227

* cited by examiner

*Primary Examiner*—Sandra O'Shea
*Assistant Examiner*—James W Cranson, Jr.
(74) *Attorney, Agent, or Firm*—William E. Meyer

(57) ABSTRACT

A solid-state light source 10 compatible with existing sockets normally reserved for filamented lamps may be formed with a hollow base 12 formed to mechanically and electrically adapt to a socket. A sub-assembly 14 adapted to cooperate with and fit into the hollow base 12 comprises a metal core 16 having a bulbous body 18 and a narrow, depending foot 20. A circuit board 22 substantially surrounds the metal core 16 on two sides. The board 22 is preferably formed from a flexible printed circuit board material capable of sustaining a bend radius of at least 0.25 inches (6 mm). Solid-state light sources 30, for example, light emitting diodes (LEDs) are mechanically and electrically connected to one side of the circuit board by suitable electrically conductive traces. A glass dome 34 covers the sub-assembly 14 after it is inserted into the hollow base 12 and is sealed thereto.

4 Claims, 5 Drawing Sheets

THERMALLY EFFICIENT LED BULB

TECHNICAL FIELD

This invention relates to light sources and more particularly to solid-state light sources. Still more particularly it relates to solid-state light sources that can be employed with a reflector to mimic the light distribution of an incandescent light. Still more particularly, it relates to solid-state light sources useable as direct replacements for automotive signal lighting, such as taillights and to such light sources having a viable heat transfer mechanism.

BACKGROUND ART

Solid-state lighting, for example, light emitting diodes (hereinafter, LED) are renowned for their long life and their ability to resist shock. They have been used for some time as the high-mount stop light in automobiles, where no particular amplification or reflection of the light is needed. Attempts have been made in the past to adapt LEDs for other purposes such as taillight units; however, these attempts have applied LEDs typically encased in plastic beads to flat surfaces, which were then ganged on the cylindrical end of, for example, a bayonet base. Little or no light was directed to the reflector for proper light distribution. For the most part, these devices do not meet Federal regulations. Further, it has been found necessary to greatly multiply the number of individual LED units to increase the light output to meet Federal regulations; however, this increase in number has also increased the amount of heat generated and this excess heat has a deleterious effect on the lamp employing the LEDs.

DISCLOSURE OF INVENTION

It is, therefore, an object of the invention to obviate the disadvantages of the prior art.

It is another object of the invention to enhance LED light sources.

It is yet another object of the invention to provide an LED light source that can be used as an after-market replacement for existing incandescent lamps.

These objects are accomplished, in one aspect of the invention by the provision of a solid-state light source compatible with existing sockets normally reserved for filamented lamps that comprises a hollow base formed to mechanically and electrically adapt to a socket and a sub-assembly adapted to cooperate with and fit into the hollow base. The sub-assembly comprises a metal core having a bulbous body and a narrow foot depending therefrom. A circuit board substantially surrounds the metal core on two sides. The circuit board has a bulbous body positioned about the bulbous body of the metal core and it has two spaced apart legs lying adjacent either side of the narrow foot. A plurality of solid-state light sources is mechanically and electrically connected to one side of the circuit board and external electrical contacts are positioned on the circuit board for connection to an electrical circuit. A glass dome covers the bulbous body of the circuit board and metal core and is sealed to the hollow base.

This construction allows for multiple solid-state devices to be employed to insure adequate light output and the metal core provides adequate heat removal.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
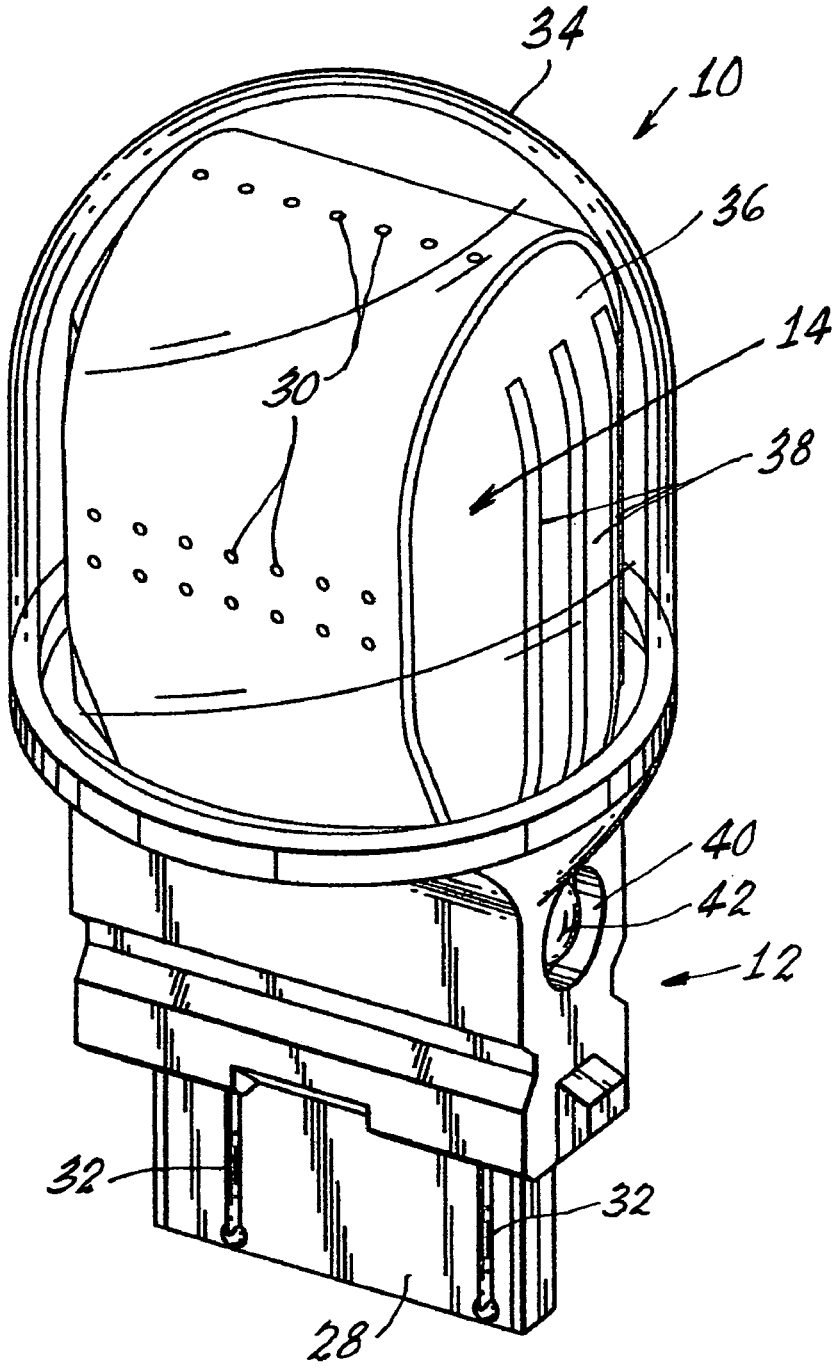
FIG. 1 is a perspective view of an embodiment of the invention.
Figure 2:
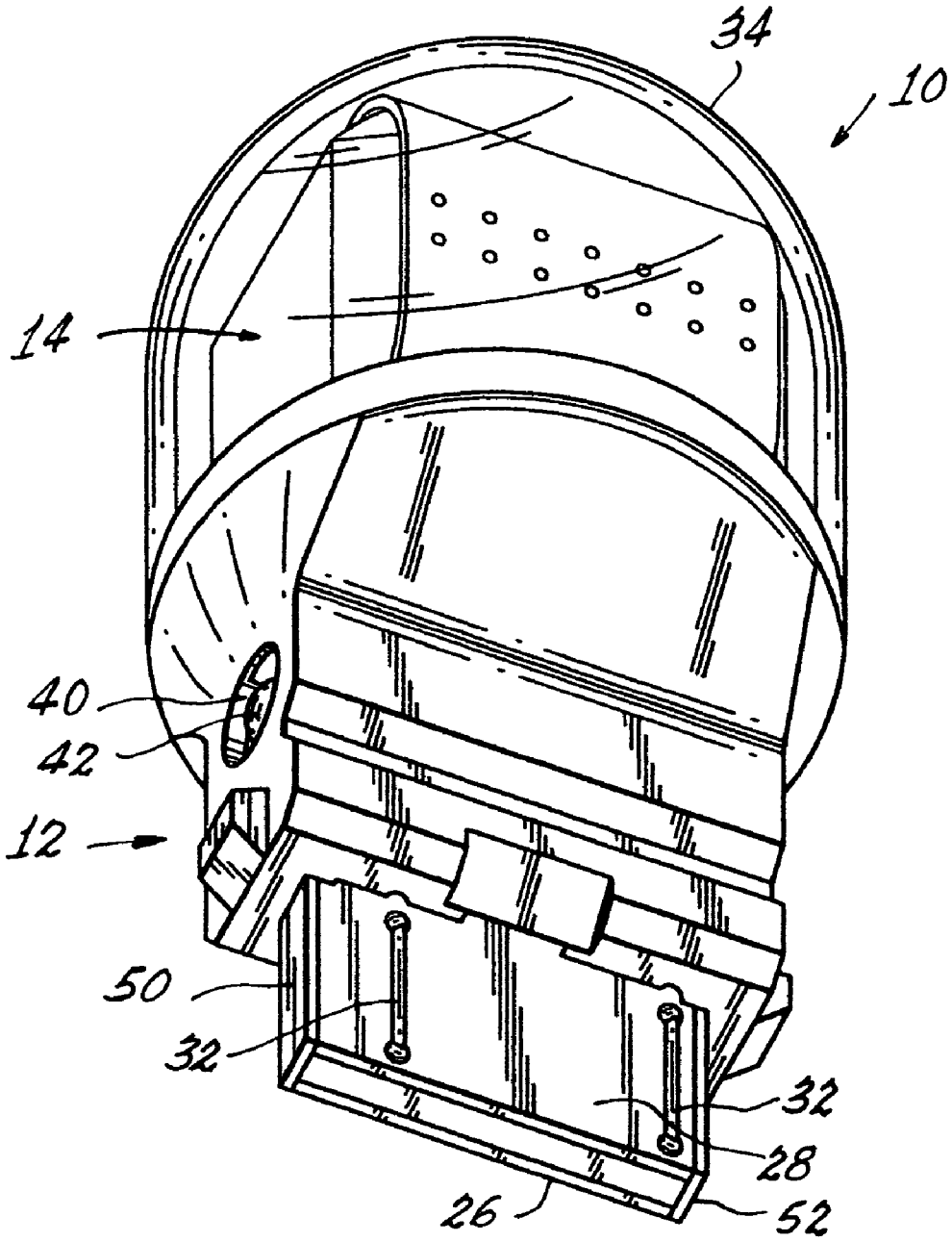
FIG. 2 is a perspective view of the embodiment of FIG. 1 from the bottom.
Figure 3:
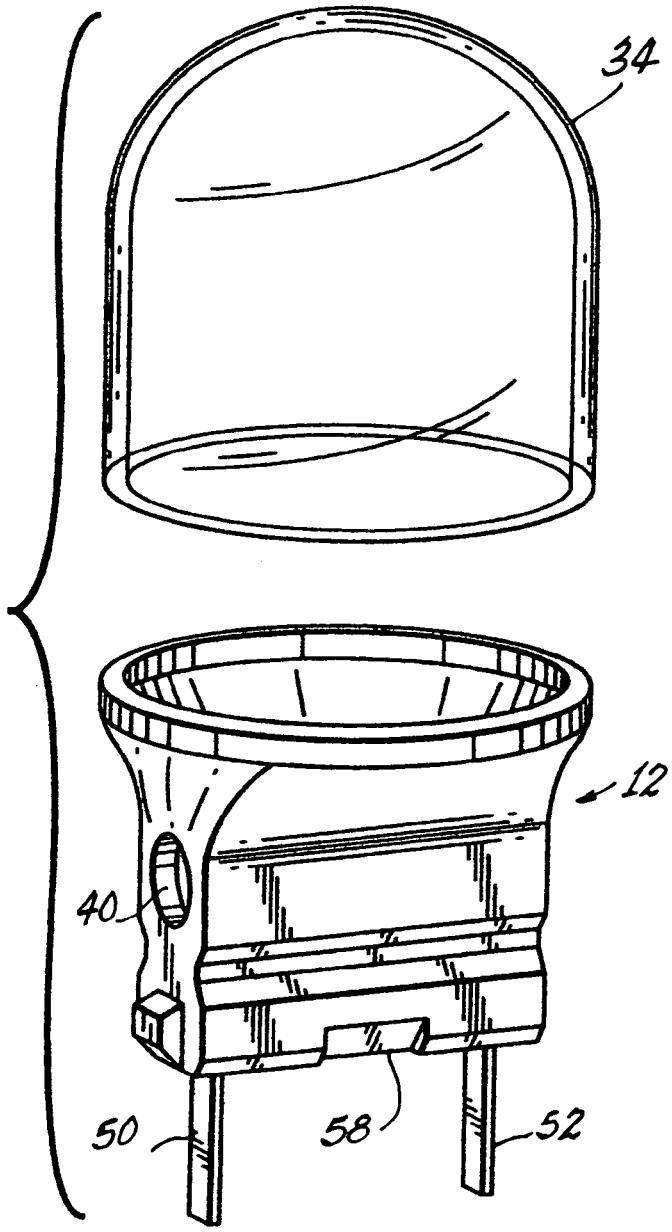
FIG. 3 is an exploded perspective view of a base and dome of the invention.
Figure 4:
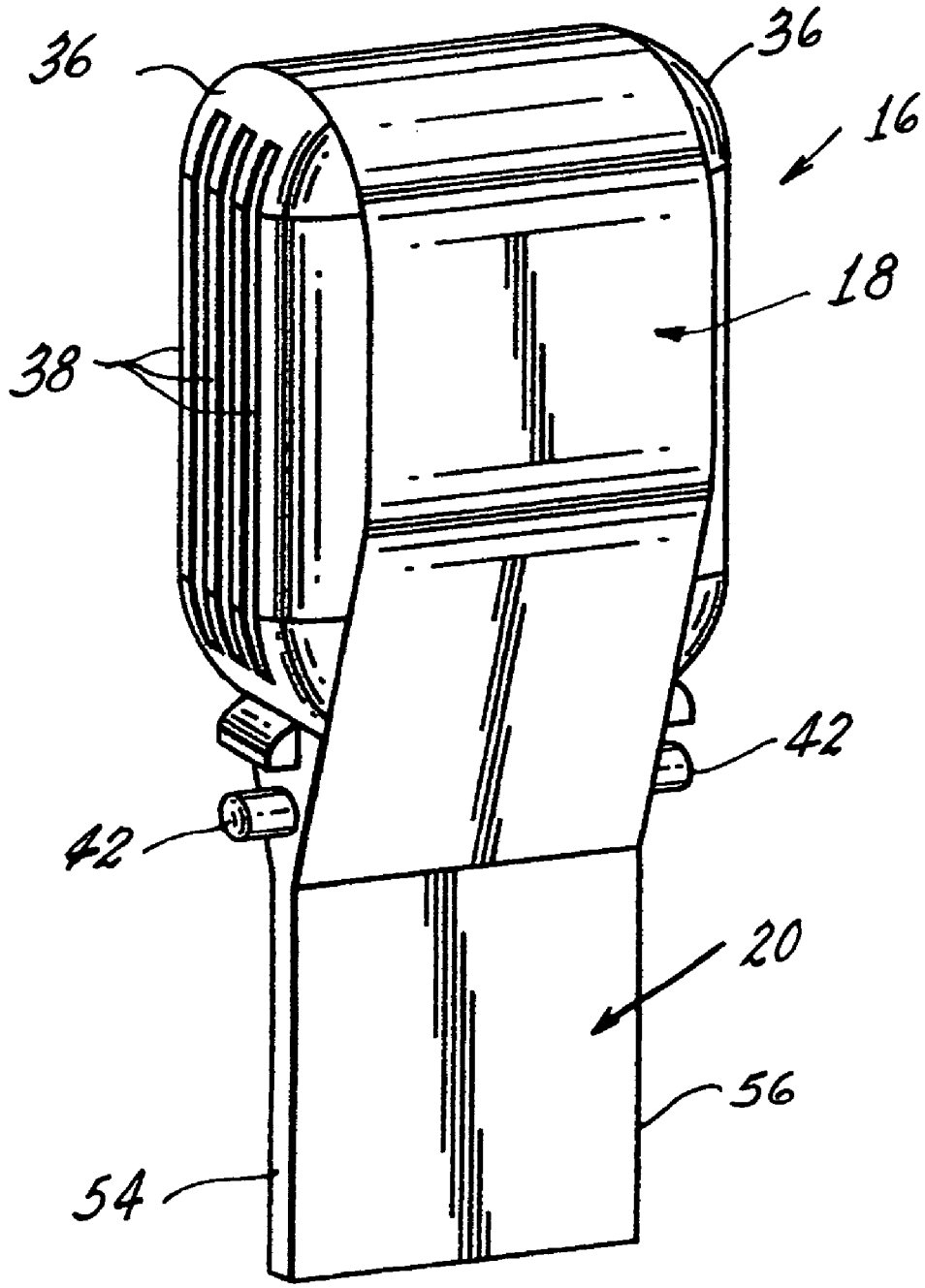
FIG. 4 is a perspective view of a metal core for use with the invention.
Figure 5:
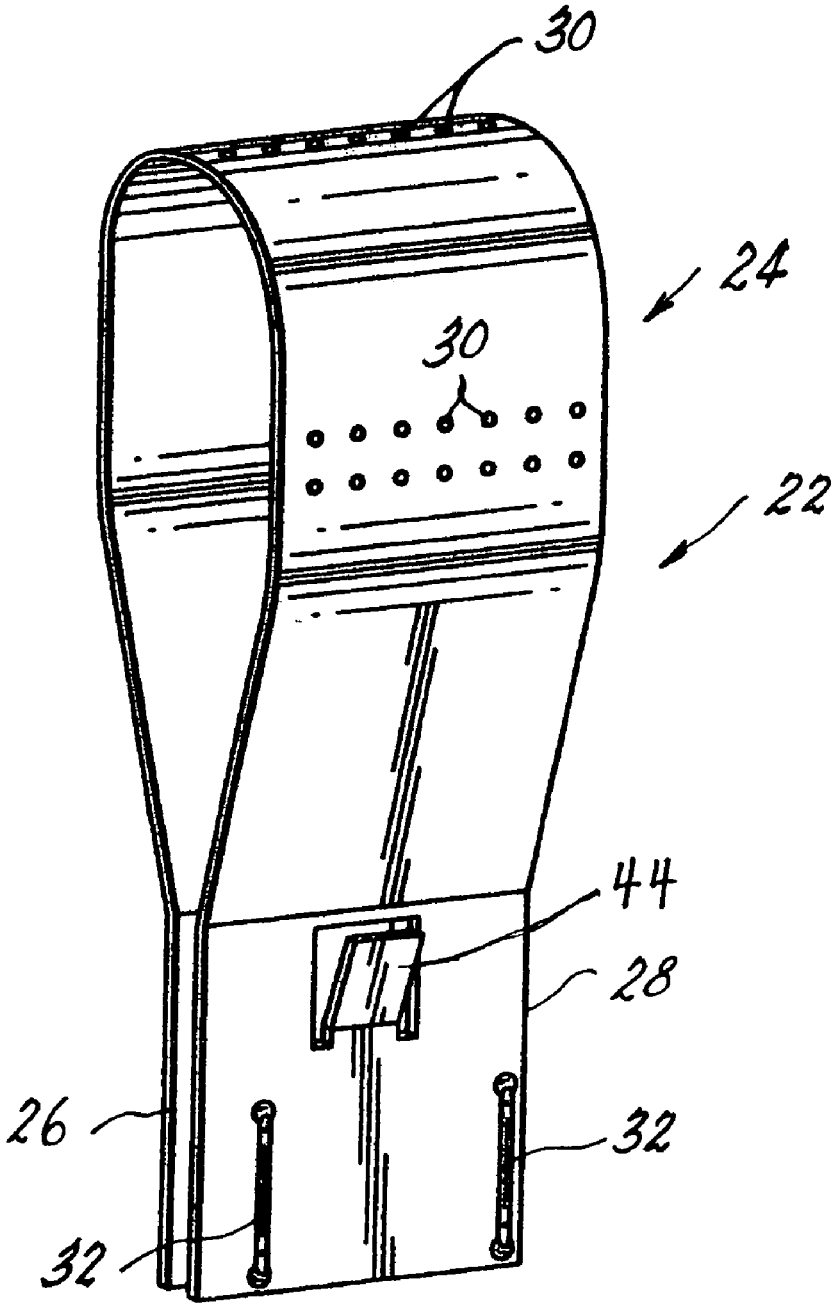
FIG. 5 is a perspective view of a circuit board employable with the invention.

Referring now to the drawings with grater particularity, there is shown in FIG. 1 a solid-state light source 10 compatible with existing sockets normally reserved for filamented lamps. The light source 10 comprises a hollow base 12 formed to mechanically and electrically adapt to a socket. The base 12 is preferably formed of plastic; however, in the event that additional heat dissipation is required, metal, with suitable insulating features, can be employed. A sub-assembly 14 that is adapted to cooperate with and fit into the hollow base 12 comprises a metal core 16 having a bulbous body 18 and a narrow foot 20 depending therefrom. The metal core 16 is preferably made from solid copper; however, other metals can be used, for example, aluminum will function as the core and can be used if weight is a concern. A circuit board 22 substantially surrounds the metal core 16 on two sides. The circuit board 22 has a bulbous body portion 24 that is positioned about the bulbous body 18 of the metal core 16 and has two spaced apart legs 26, 28 lying adjacent either side of the narrow foot 20. The board 22 is preferably formed from a flexible printed circuit board material capable of sustaining a bend radius of at least 0.25 inches (6 mm). For the primary benefits to be obtained, the circuit board 22 must be positioned around the metal core 16 to be in good thermal contact to conduct the heat generated by the LEDs away. For this purpose a thermal glue or paste can be employed between the board and the core.

A plurality of solid-state light sources 30, for example, light emitting diodes (LEDs) are mechanically and electrically connected to one side of the circuit board by suitable electrically conductive traces, not shown. External electrical contacts 32 are positioned on the circuit board 22 on the legs 26, 28, for connection to an electrical circuit via a suitable socket, into which the light source 10 will be inserted. A glass dome 34 covers the sub-assembly 14 after it is inserted into the hollow base 12 and is sealed thereto. While any suitable glass can be employed it is preferred that the glass be an efficient radiator for infrared emissions. Such a glass is alumina silicate.

To further aid in the elimination of generated heat, a thermally efficient fluid can fill the interior of the dome. Such a thermally efficient fluid can be a gas, such as hydrogen or helium, a liquid such as silicon, or a vacuum.

The sides 36 of the metal core 16 not covered by the circuit board 22 can be provided with heat radiating ribs 38. The heat radiating ribs have large exposures going sideways from the lamp providing a large heat-radiating surface.

The hollow base 12 includes a locking receptacle 40 and depending arms 50, 52 that cover the edges 54, 56 of the narrow foot 20 when the sub-assembly 14 is placed in the base 12. The metal core 16 includes a matching lock 42 for engaging the locking receptacle 40.

At least one of the legs 26, 28 (preferably, both legs) of the circuit board 22 is provided with a latch 44 and the hollow base 12 has a latch receiver 58 to mate therewith.

The color emission of the LEDs will be chosen to be suitable for the ultimate purpose of the light source. For example, if the light source is designed for use as a taillight for an automobile, re emitting LEDs will be used. A mix of red, green and blue light emitting LEDs can generate white light There is thus provided a solid-state light source that is acceptable for use as an automobile taillight, as original equipment or as a replacement item.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A solid-state light source compatible with existing sockets normally reserved for filamented lamps comprising:

a hollow base formed to mechanically and electrically adapt to a socket: and a sub-assembly adapted to cooperate with and fit into said hollow base, said sub-assembly comprising:

a metal core having a bulbous body and a narrow foot depending therefrom;

a flexible circuit board flexed to be formed about said metal core, and surround said metal core on two sides, said circuit board having a bulbous body positioned about said bulbous body of said metal core and having two spaced apart legs lying adjacent either side of said narrow foot;

a plurality of solid-state light sources mechanically and electrically connected to one side of said circuit board;

external electrical contacts positioned on said circuit board for connection to an electrical circuit; and a glass dome covering said bulbous body of said circuit board and sealed to said hollow base.

2. A solid-state light source compatible with existing sockets normally reserved for filamented lamps comprising:

a hollow base formed to mechanically and electrically adapt to a socket: and a sub-assembly adapted to cooperate with and fit into said hollow base, said sub-assembly comprising:

a metal core having a bulbous body and a narrow foot depending therefrom;

a circuit board substantially surrounding said metal core on two sides, said circuit board having a bulbous body positioned about said bulbous body of said metal core and having two spaced apart legs lying adjacent either side of said narrow foot;

a plurality of solid-state light sources mechanically and electrically connected to one side of said circuit board;

external electrical contacts positioned on said circuit board for connection to an electrical circuit;

a glass dome covering said bulbous body of said circuit board and sealed to said hollow base, and wherein said sides of said metal core not covered by said circuit board are provided with heat radiating ribs.

3. A solid-state light source compatible with existing sockets normally reserved for filamented lamps comprising:

a hollow base formed to mechanically and electrically adapt to a socket: and a sub-assembly adapted to cooperate with and fit into said hollow base, said sub-assembly comprising:

a metal core having a bulbous body and a narrow foot depending therefrom;

a circuit board substantially surrounding said metal core on two sides, said circuit board having a bulbous body positioned about said bulbous body of said metal core and having two spaced apart legs lying adjacent either side of said narrow foot;

a plurality of solid-state light sources mechanically and electrically connected to one side of said circuit board;

external electrical contacts positioned on said circuit board for connection to an electrical circuit;

a glass dome covering said bulbous body of said circuit board and sealed to said hollow base, and wherein said hollow base includes a locking receptacle and said metal core includes a matching lock.

4. A solid-state light source compatible with existing sockets normally reserved for filamented lamps comprising:

a hollow base formed to mechanically and electrically adapt to a socket: and a sub-assembly adapted to cooperate with and fit into said hollow base, said sub-assembly comprising:

a metal core having a bulbous body and a narrow foot depending therefrom;

a circuit board substantially surrounding said metal core on two sides, said circuit board having a bulbous body positioned about said bulbous body of said metal core and having two spaced apart legs lying adjacent either side of said narrow foot;

a plurality of solid-state light sources mechanically and electrically connected to one side of said circuit board;

external electrical contacts positioned on said circuit board for connection to an electrical circuit;

a glass dome covering said bulbous body of said circuit board and sealed to said hollow base, and wherein at least one of said legs of said circuit board is provided with a latch and said hollow base has a latch receiver to mate therewith.

* * * * *